US012471715B1

(12) United States Patent
Flannery et al.

(10) Patent No.: US 12,471,715 B1
(45) **Date of Patent: *Nov. 18, 2025**

(54) BED RAIL WITH OFFSET RAILS

(71) Applicant: Regalo International, LLC, Burnsville, MN (US)

(72) Inventors: Mark A. Flannery, Longboat Key, FL (US); Kasey L. Pipo, Elko New Market, MN (US)

(73) Assignee: Regalo International, LLC, Burnsville, MN (US)

( * ) Notice: Subject to any disclaimer, the term of this patent is extended or adjusted under 35 U.S.C. 154(b) by 677 days.

This patent is subject to a terminal disclaimer.

(21) Appl. No.: 17/827,766

(22) Filed: May 29, 2022

Related U.S. Application Data

(63) Continuation of application No. 16/593,969, filed on Oct. 4, 2019, now Pat. No. 11,350,760.

(60) Provisional application No. 62/741,652, filed on Oct. 5, 2018.

(51) Int. Cl.
*A47C 21/08* (2006.01)

(52) U.S. Cl.
CPC ..... *A47C 21/08* (2013.01)

(58) Field of Classification Search
CPC ..... A47C 21/08; A47D 7/02; A61G 7/0507; A61G 7/0508; A61G 7/0509; A61G 7/0518; A61G 7/0519
USPC ..... 5/428
See application file for complete search history.

(56) References Cited

U.S. PATENT DOCUMENTS

| | | | | |
|---|---|---|---|---|
| 3,290,701 | A | 12/1966 | Luff | |
| 4,833,743 | A | 5/1989 | Howell | |
| 5,640,726 | A | 6/1997 | Fichner-Rathus | |
| 5,671,490 | A | 9/1997 | Wu | |
| 6,952,846 | B2 | 10/2005 | Flannery et al. | |
| 6,990,697 | B1 | 1/2006 | Clute | |
| 7,028,353 | B2 | 4/2006 | Waldman | |
| 7,137,158 | B2 | 11/2006 | Flannery et al. | |
| 7,178,184 | B2 | 2/2007 | Flannery et al. | |
| 7,181,788 | B2 | 2/2007 | Flannery et al. | |
| 7,237,285 | B2 * | 7/2007 | Brewin | A47C 21/08 5/426 |
| 7,302,720 | B2 | 12/2007 | Flannery et al. | |
| 7,373,679 | B2 | 5/2008 | Miller | |
| 7,908,689 | B2 | 3/2011 | Flannery et al. | |
| 8,091,163 | B2 | 1/2012 | Flannery | |
| 8,365,324 | B2 | 2/2013 | Flannery | |
| 8,458,831 | B2 | 6/2013 | Flannery et al. | |
| 8,555,436 | B2 | 10/2013 | Flannery et al. | |
| 8,631,525 | B2 | 1/2014 | Flannery | |
| 8,726,433 | B1 | 5/2014 | Flannery et al. | |
| 8,966,682 | B1 | 3/2015 | Flannery et al. | |
| 9,125,498 | B2 | 9/2015 | Flannery | |
| 9,155,400 | B1 | 10/2015 | Flannery et al. | |
| 9,265,353 | B1 | 2/2016 | Flannery et al. | |
| 9,387,141 | B1 | 7/2016 | Flannery et al. | |
| 9,427,089 | B2 * | 8/2016 | Marsden | A47C 21/08 |

(Continued)

*Primary Examiner* — David R Hare

(57) ABSTRACT

The present bed rail with offset rails includes a rail portion swingably engaged to first and second leg portions about first and second axis. The rail portion includes first and second end frame portions extending from the first and second axis and defining a plane having a front face and a rear face. The rail portion includes an offset frame portion disposed forwardly of the front face of the plane and spaced from the front face of the plane.

6 Claims, 12 Drawing Sheets

(56) References Cited

U.S. PATENT DOCUMENTS

| | | | | |
|---|---|---|---|---|
| 9,687,081 | B1 | 6/2017 | Flannery | |
| 10,117,524 | B1 | 11/2018 | Flannery et al. | |
| 11,350,760 | B1 * | 6/2022 | Flannery | A47C 21/08 |
| 2004/0128763 | A1 * | 7/2004 | Nygren | A47C 21/08 5/426 |
| 2004/0187209 | A1 | 9/2004 | Flannery | |
| 2012/0084915 | A1 | 4/2012 | Flannery | |

* cited by examiner

BED RAIL WITH OFFSET RAILS

This application is a continuation of U.S. patent application Ser. No. 16/593,969 filed Oct. 4, 2019 (U.S. Pat. No. 11,350,760 issued Jun. 7, 2022) and claims the benefit thereof under 35 U.S.C. § 120, which application claims the benefit under 35 U.S.C. 119(e) of U.S. Provisional Patent Application No. 62/741,652 filed Oct. 5, 2018, all of which nonprovisional and provisional applications are hereby incorporated by reference in their entireties into this application.

FIELD OF THE INVENTION

The present invention relates generally to a bed rail, particularly to a swing down bed rail, and specifically to a swing down bed rail with a first portion of the rail defining a swing up and swing down plane and with a second portion of the rail being offset so as to be between the swing up and swing down plane and the bed.

BACKGROUND OF THE INVENTION

A gap may exist between a bed rail and the side of a mattress. One way to minimize the gap is to have a built in acute angle to the bed rail such that the rail portion of the bed rail angles in toward the side of the mattress. Another way to minimize the gap is to have a counter member engage the opposite side of the bed such that the counter member and bed rail squeeze the mattress therebetween.

SUMMARY OF THE INVENTION

A feature of the present invention is the provision in a swing down bed rail for a bed, of a rail portion for being disposed adjacent to a first side of the mattress, where the rail portion extends from the first side of the mattress to beyond the sleeping surface to minimize a person rolling off the sleeping surface, and where the rail portion includes a length and a height.

Another feature of the present invention is the provision in a swing down bed rail for a bed, of first and second leg portions for being disposed between a mattress and mattress support such as a box spring.

Another feature of the present invention is the provision in a swing down bed rail for a bed, of the rail portion being swingably engaged to each of the first and second leg portions about first and second axis, respectively, such that the rail portion can swing from being disposed adjacent the first side of the mattress to being disposed adjacent to the first side of the mattress support.

Another feature of the present invention is the provision in a swing down bed rail for a bed, of the rail portion including a first end frame portion extending from the first axis and a second end frame portion extending from the second axis, where the first and second end frame portions define a plane having a front face and a rear face.

Another feature of the present invention is the provision in a swing down bed rail for a bed, of the front face of the plane facing toward the first side of the mattress when the rail portion is disposed adjacent to the first side of the mattress.

Another feature of the present invention is the provision in a swing down bed rail for a bed, of the rear face of the plane facing away from the first side of the mattress when the rail portion is disposed adjacent to the first side of the mattress.

Another feature of the present invention is the provision in a swing down bed rail for a bed, of the rear face of the plane facing toward the first side of the mattress support when the rail portion is disposed adjacent to the first side of the mattress support.

Another feature of the present invention is the provision in a swing down bed rail for a bed, of the front face of the plane facing away from the first side of the mattress support when the rail portion is disposed adjacent to the first side of the mattress support.

Another feature of the present invention is the provision in a swing down bed rail for a bed, of the rail portion including an offset frame portion disposed forwardly of the front face of the plane and spaced from the front face of the plane, where the offset frame portion extends one of a) greater than half the length of the rail portion, and b) greater than half the height of the rail portion.

Another feature of the present invention is the provision in a swing down bed rail for a bed, of the offset frame portion extending greater than half the length of the rail portion.

Another feature of the present invention is the provision in a swing down bed rail for a bed, where the offset frame portion extends greater than half the height of the rail portion.

Another feature of the present invention is the provision in a swing down bed rail for a bed, of the offset frame portion extending greater than 70% of the length of the rail portion.

Another feature of the present invention is the provision in a swing down bed rail for a bed, of the offset frame portion extending greater than 75% the height of the rail portion.

Another feature of the present invention is the provision in a swing down bed rail for a bed, of the rail portion including a first end frame member, a second end frame member, an uppermost crossing frame member, a lowermost crossing frame member, and an intermediate crossing frame member that is disposed a) above the lowermost crossing member when the rail portion is disposed adjacent to the first side of the mattress and b) below the uppermost crossing member when the rail portion is disposed adjacent to the first side of the mattress.

Another feature of the present invention is the provision in a swing down bed rail for a bed, of the first end frame member being in the plane, of the second end frame member being in the plane, of the lowermost crossing frame member being disposed forwardly of and spaced from the plane and being part of the offset frame portion, and the intermediate crossing frame member being disposed forwardly of and spaced from the plane and being part of the offset frame portion.

Another feature of the present invention is the provision in a swing down bed rail for a bed, of the first end frame member being in the plane, of the second end frame member being in the plane, of the lowermost crossing frame member being disposed forwardly of and spaced from the plane and being part of the offset frame portion, of the intermediate crossing frame member being disposed forwardly of and spaced from the plane and being part of the offset frame portion, and the uppermost crossing frame member being in the plane.

Another feature of the present invention is the provision in a swing down bed rail for a bed, of the first end frame member being disposed forwardly of and spaced from the plane and being part of the offset frame portion, of the second end frame member being disposed forwardly of and spaced from the plane and being part of the offset frame portion, of the uppermost crossing frame member being disposed forwardly of and being spaced from the plane and being part of the offset frame portion, of the intermediate crossing frame member being disposed forwardly of and being spaced from the plane and being part of the offset frame portion.

Another feature of the present invention is the provision in a swing down bed rail for a bed, of the first end frame member being disposed forwardly of and spaced from the plane and being part of the offset frame portion, of the second end frame member being disposed forwardly of and spaced from the plane and being part of the offset frame portion, of the uppermost crossing frame member being disposed forwardly of and being spaced from the plane and being part of the offset frame portion, of the intermediate crossing frame member being disposed forwardly of and being spaced from the plane and being part of the offset frame portion, and of the lowermost crossing frame member being disposed forwardly of and being spaced from the plane and being part of the offset frame portion.

An advantage of the present invention is that a gap between the side of a mattress and a bed frame is minimized.

Another advantage is that more than one frame portion of the rail portion is offset. For example, in a first embodiment of the invention, each of an intermediate and lowermost crossing frame members is offset from and forwardly of a plane defined by end frame members extending from right and left pivot connections between the rail portion and leg portions of the bed rail. In a second embodiment, a portion of each of the end frame members is offset as well as each of an intermediate, uppermost, and lowermost crossing frame members being offset.

Another advantage of the present invention is that frame members that are transverse to each other may be offset. For example, in the second embodiment of the invention, the end frame members are transverse to the intermediate, uppermost, and lowermost crossing frame members.

Another advantage of the present invention is that the present bed rail is inexpensive to manufacture.

Another advantage of the present invention is that the present bed rail is no more expensive than conventional bed rails having no offset frame portions.

Another advantage of the present invention is simple and easy to set up, to operate and use, and to take down.

Another advantage of the present invention is a high degree of portability. The present invention is relatively lightweight and may be packaged in a relatively small box.

DESCRIPTION

Figure 1:
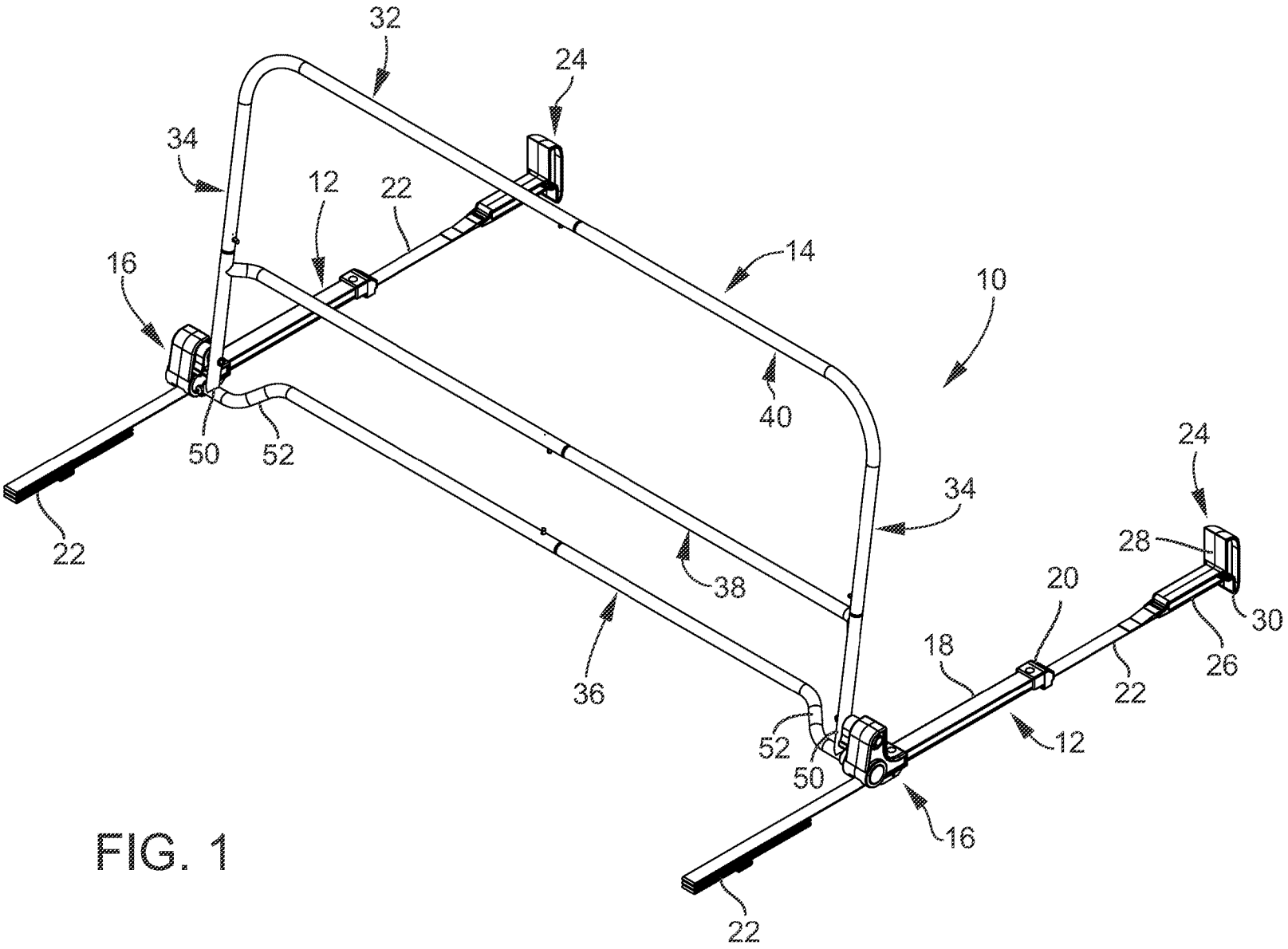
FIG. 1 is a perspective view of a first embodiment of an offset bed rail.

As shown in FIG. 1, the present bed rail with offset rails is indicated in general by the reference number 10. Bed rail 10 includes a pair of leg portions 12, a rail portion 14, and a pair of bases 16. The rail portion 14 is swingably engaged to the bases 16. The leg portion 12 is fixedly engaged to its respective base 16.

Each of the leg portions 12 includes a straight metal tubular leg 18 fixedly received in its respective base 16. At its distal end, the tubular leg 18 is closed off by an end cap 20. Leg portion 12 includes a flexible strap 22 and a counter member 24. Flexible strap 22 is engaged to the underside of the tubular leg 18 by a slot formed in the underside of the cap 20 and by a catch mechanism 25 depending from a proximal end portion of the tubular leg 18 adjacent to the base 16. Flexible strap 22 may be adjustably lengthened and shortened to let out and draw in the counter member 24 that is engaged to a distal end of the flexible strap 22. Counter member 24 includes a planar portion 26, an upright portion 28 that confronts a side of a mattress, and a downwardly extending portion 30 that confronts a side of a mattress support. By pulling on the proximal end of the strap 22 and operating the catch mechanism 25 on the bottom side of the proximal end of the tubular leg 18, the counter member 24 may be drawn tightly against the far side of the mattress and mattress support to squeeze the mattress between the counter member 24 and the bases 16 and rail portion 14.

Rail portion 14 is a portion of the bed rail 10. Another portion of the bed rail 10 is the leg portion 12. Another portion of the bed rail 10 is the pair of bases 16. Another portion of the bed rail 10 is sheeting on the rail portion 14.

Rail portion 14 includes a frame 32. Frame 32 includes a pair of end rails 34, a lowermost crossing rail 36, an intermediate crossing rail 38, and an uppermost crossing rail 40. Crossing rails 36, 38, 40 extend across the rail portion 14 from one end rail 34 to the other end rail 34.

Figure 2:
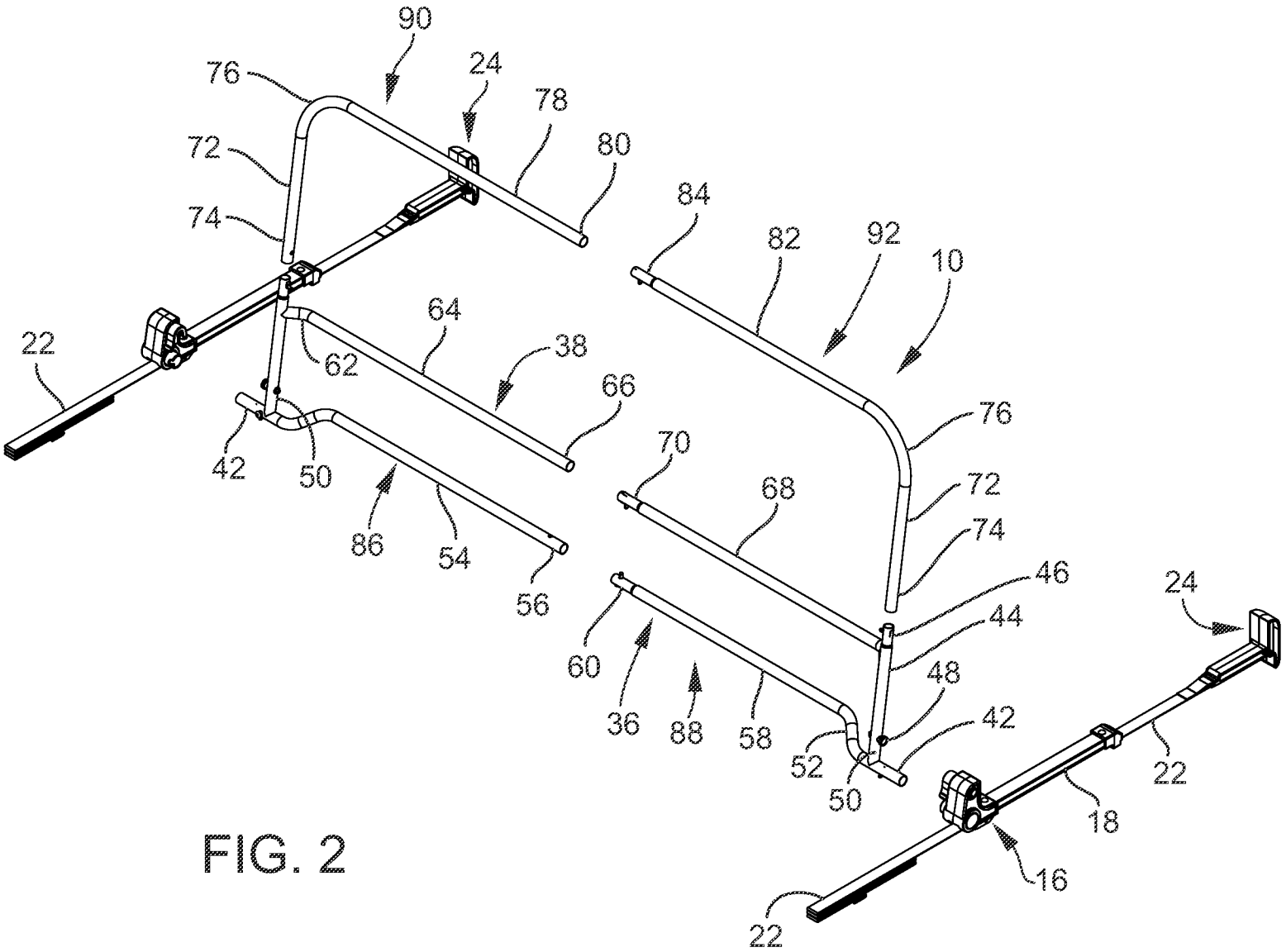
FIG. 2 is an exploded perspective view of the offset bed rail of FIG. 1.

As shown in FIG. 2, lowermost crossing rail 36 includes a pair of straight pivot frame portions 42 that are outer end portions of lowermost crossing rail 36. Pivot frame portion 42 is pivotally engaged to its respective base 16. Rail portion 14 swings upwardly and downwardly relative to bases 16 and leg portions 12 through pivot frame portions 42. Pivot frame portion 42 extends inwardly from its respective base 16 to and slightly beyond its respective end rail 34.

Each of the end rails 34 includes a lowermost straight end rail portion 44. End rail portion 44 is engaged to lowermost crossing rail 36 at a right angle. Lowermost end rail portion 44 includes a distal end 46 that is a male connecting portion and that includes a spring biased button. Lowermost end rail portion 44 includes a headed spring biased connector pin 48 that engages its respective base 16 to fix the rail portion 14 in an operating position adjacent to the side of the mattress and not adjacent to the side of the mattress support. When the head of the connector pin 48 is disengaged from its respective base 16, the rail portion 14 can swing down so as to be adjacent to the side of the mattress support and not adjacent to the side of the mattress.

A left straight frame portion 50 of the left lowermost end rail portion 44 extends between the left connector pin 48 and the left pivot frame portion 42. A right straight frame portion 50 of the right lowermost end rail portion 44 extends between the right connector pin 48 and the right pivot frame portion 42. Axis of the left and right frame portions 50 define a base plane. When the rail portions 44 and frame portions 50 swing, so does the base plane swing. Frame portions of the rail portion 14, as discussed below, are disposed forwardly of and spaced from the base plane.

As indicated above, pivot frame portion 42 extends in a straight manner inwardly from its respective base 16 to and slightly beyond its respective end rail 34. Slightly inwardly of each of the respective end rails 34, the straight pivot frame portion 42 terminates where its straight structure terminates, and here lowermost rail 36 curves forwardly of the base plane and into a pair of left and right offset S-shaped transition tubular frame portions 52. The axis of left and right offset frame portions 52 lie forwardly of and are spaced from the base plane defined by the axis of frame portions 50.

Extending from the left S-shaped frame portion 52 is a straight offset tubular frame portion 54 with a female connector inner end 56. Extending from the right S-shaped frame portion 52 is a straight offset tubular frame portion 58 with a male connector inner end 60. Male connector inner end 60 includes a spring biased button that engages a button hole in the female connector inner end 56 such that female connector inner end 56 engages male connector inner end 60. Frame portions 54, 58 are aligned with each other such that both lie on the same straight axis when engaged with each other. The axis of frame portions 54, 58 lie forwardly of and are spaced from the base plane defined by the axis of frame portions 50. Frame portions 54, 58 as a whole lie forwardly of and are spaced from the base plane defined by the axis of frame portions 50.

Rail portion 14 includes intermediate rail 38. Intermediate rail 38 includes a left outer end transition tubular frame portion 62 and a right outer end transition tubular frame portion 62. Each of the frame portions 62 extends inwardly from lowermost end rail portion 44. The axis of frame portions 62 lie forwardly of and are spaced from the base plane defined by the axis of frame portions 50.

Extending from the left transition frame portion 62 is a straight offset tubular frame portion 64 with a female connector inner end 66. Extending from the right transition frame portion 62 is a straight offset tubular frame portion 68 with a male connector inner end 70. Male connector inner end 70 includes a spring biased button that engages a button hole in the female connector inner end 66 such that female connector inner end 66 engages male connector inner end 70. Frame portions 64, 68 are aligned with each other such that both lie on the same straight axis when engaged with each other. The axis of frame portions 64, 68 lie forwardly of and are spaced from the base plane defined by the axis of frame portions 50. Frame portions 64, 68 as a whole lie forwardly of and are spaced from the base plane defined by the axis of frame portions 50.

Rail portion 14 includes a pair of left and right straight uppermost tubular end frame portions 72 that lie on the same straight axis as lowermost end rail portions 44. Each of the left and right straight uppermost end rail portions 72 include female lower connector ends 74 that receive and engage the distal male ends 46 of the lowermost end rail portions 44.

Rail portion 14 includes a pair of left and right curved transition tubular frame portions 76 that are integral and one piece with uppermost left and right uppermost end frame portions 72.

Extending from the left curved transition frame portion 76 is a straight tubular uppermost frame portion 78 with a female connector inner end 80. Extending from the right curved transition frame portion 76 is a straight tubular frame uppermost frame portion 82 with a male connector inner end 84. Male connector inner end 84 includes a spring biased button that engages a button hole in the female connector inner end 80 such that female connector inner end 80 engages male connector inner end 84. Frame portions 78, 82 are aligned with each other such that both lie on the same straight axis when engaged with each other.

The straight axis of frame portions 78, 82 lie in the base plane. The straight axis of frame portions 44 and 72 also lie in the base plane. The curved axis of frame portions 76 also lie in the base plane. The straight axis of pivot frame portions 42 also lie in the base plane.

Figure 3:
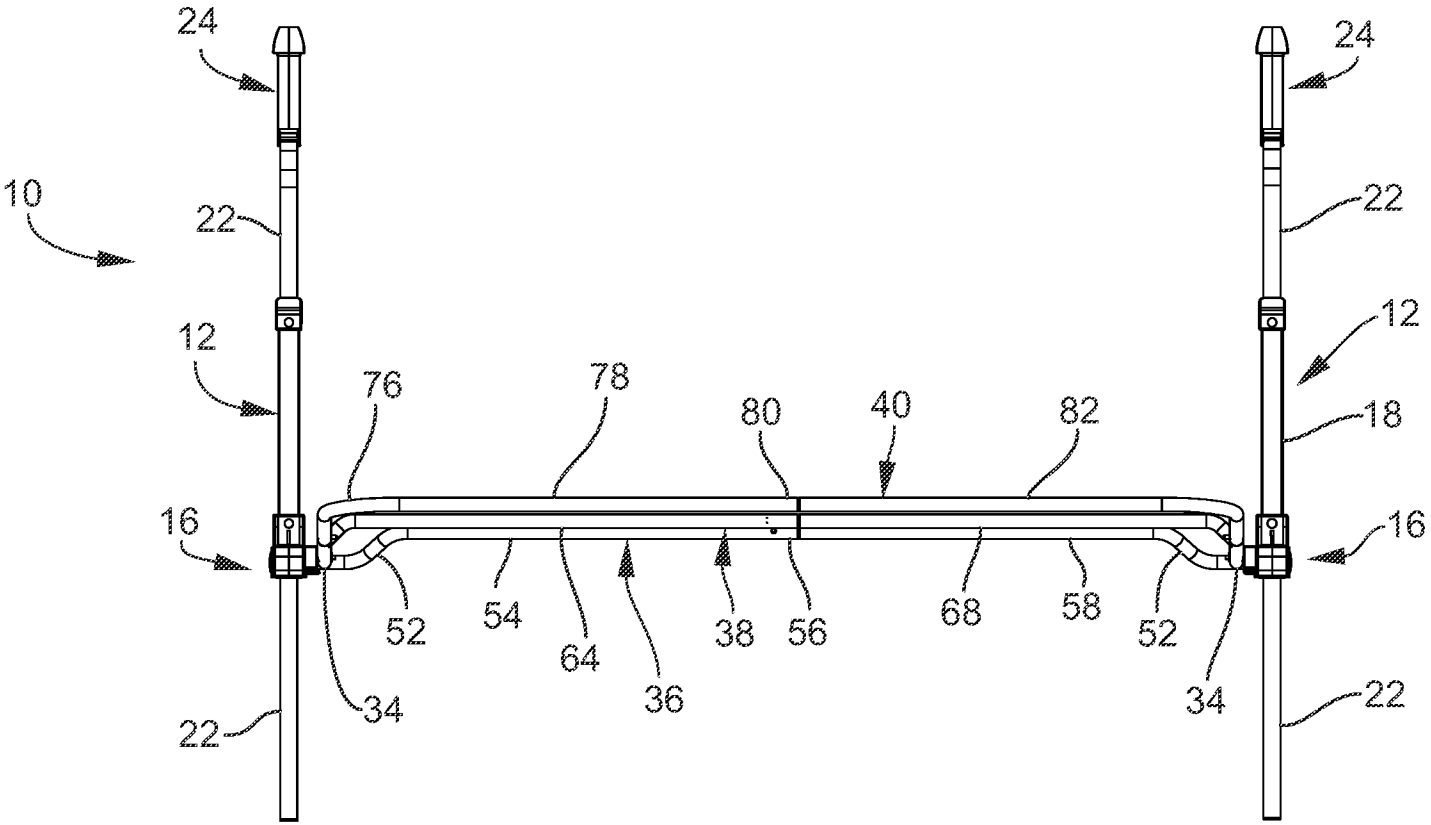
FIG. 3 is a top view of the offset bed rail of FIG. 1.
Figure 4:
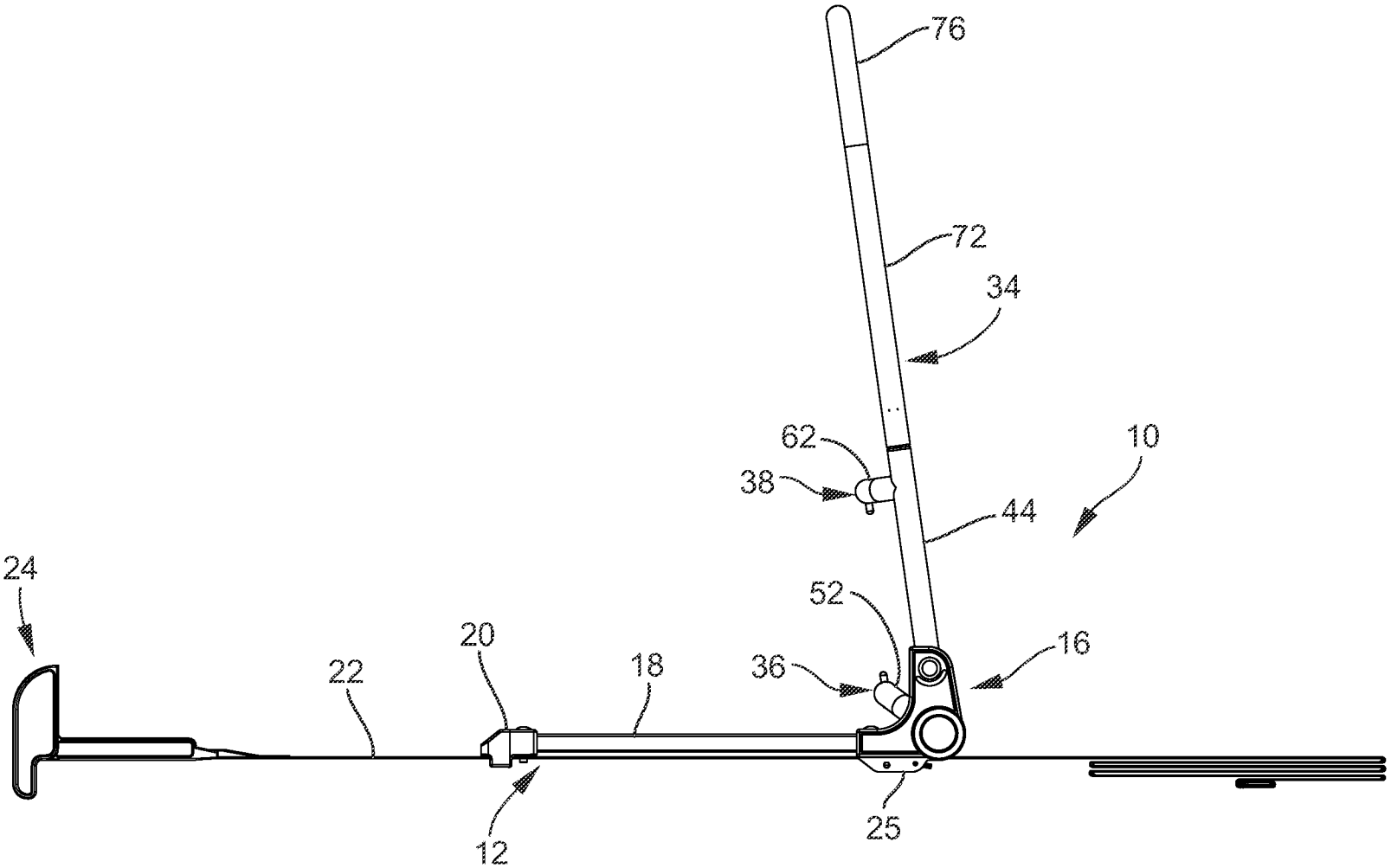
FIG. 4 is a side view of the offset bed rail of FIG. 1.
Figure 5:
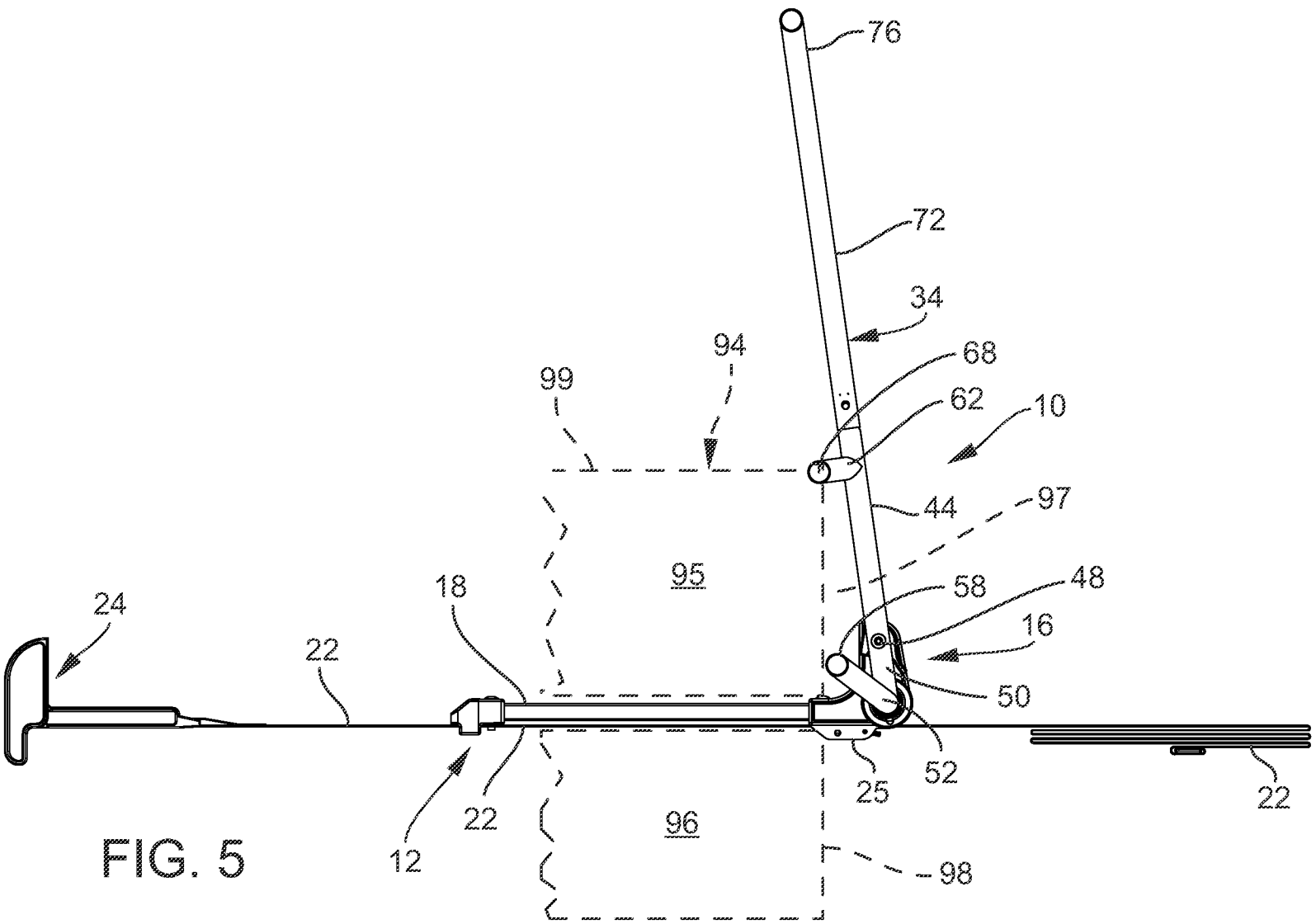
FIG. 5 is a section view of the offset bed rail of FIG. 1.

FIGS. 3, 4 and 5 show that straight end rails 34 are oblique relative to a first plane that extends at a right angle to a second plane defined by the tubular legs 18.

FIG. 3 shows that the frame portions 54 and 58 make up preferably more than one-half the length of the bed rail 10, and more preferably, more than 70% of the length of the bed rail 10 as measured from the outermost portion of left base 16 to the outermost portion of right base 16. FIG. 3 shows that the frame portions 64 and 68 make up preferably more than one-half the length of the bed rail 10, and more preferably, more than 70% of the length of the bed rail 10 as measured from the outermost portion of left base 16 to the outermost portion of right base 16. The end rails 34 of bed rail 10 have no offset frame portions such that there is no measurement for the percentage of the rail portion 14 having offset frame portions.

FIG. 5 shows frame member 50. FIGS. 4 and 5 show that the axis of frame portions 54, 58 lie forwardly of and are spaced from the base plane defined by the axis of frame portions 50, that frame portions 54, 58 as a whole lie forwardly of and are spaced from the base plane defined by the axis of frame portions 50, that the axis of frame portions 64, 68 lie forwardly of and are spaced from the base plane defined by the axis of frame portions 50, and that frame portions 64, 68 as a whole lie forwardly of and are spaced from the base plane defined by the axis of frame portions 50.

As shown by the exploded view of FIG. 2, rail portion 14 includes four frame units 86, 88, 90, 92. In each of the units 86, 88, 90, and 92, the parts are integral and one piece with each other. The units 86, 88, 90, 92 are shipped in the integral and one piece form. The units 86, 88, 90, 92 are engaged to each other by the end user to form the rail portion 14. The left lowermost unit 86 includes frame portions 54, 64, 52, 50, 62, 42 and 44. The right lowermost unit 88 includes frame portions 58, 68, 52, 50, 62, 42, and 44. The left uppermost unit 90 includes frame portions 78, 76, and 72. The right uppermost unit 92 includes frame portions 82, 76, and 72.

In operation, the bed rail 10 is shipped in the broken apart form shown in FIG. 2. Base 16 is one piece with tubular leg 18 in the shipped form. Strap 22 is engaged with tubular leg 18 and with counter member 24 in the shipped form. The end user then engages left and right male portions 46 with their respective left and right female connection portions 74. The end user then engages female inner ends 56, 66, and 80 with their respective male ends 60, 70, and 84. With the exception that unit 90 is identical to unit 92 such that either unit 90 or 92 can be a left or right uppermost unit, there is only one unique way that the bed rail 10 can be put together and such unique way is the correct way.

In operation, to engage the bed rail 10 to a bed 94 having a mattress 95 and a mattress support 96, where the mattress 95 includes a side 97 and the mattress support 96 includes a side 98, and where the mattress 95 includes a sleeping surface 99, the rail portion 14 is swung up and locked in the operating position such that each of the connector pins 48 engages both its respective base 16 and the rail portion 14.

Then the leg portions 12 are tucked between the mattress 95 and the mattress support 96 and the strap 22 with the counter member 24 is pulled through the space between the mattress 95 and mattress support 96 such that the counter member 24 can engage the mattress and mattress support sides that are opposite of sides 97, 98. Then strap 22 is tightened until the mattress side 97 makes contact with the end rails 34 and further makes contact with the intermediate rail 38 and lowermost rail 36.

Intermediate rail 38, especially intermediate frame portions 64, 68 can be positioned 1) at the junction of mattress side 97 and sleeping surface or mattress top 99, 2) at a location digging into the mattress side 97 adjacent to the sleeping surface or mattress top 99, or 3) at the immediate top of the sleeping surface or mattress top 99 overlying a portion of the sleeping surface or mattress top 99. Lowermost rail 36, especially lowermost frame portions 54, 58 can be disposed 1) at a location immediately at or adjacent to mattress side 97, or 2) at a location digging into mattress side 97.

Intermediate rail 38 extends inwardly further than does lowermost rail 36 such that intermediate frame tube portions 64, 68 dig into mattress side 97 and such that lowermost frame portions 54, 58 make contact with mattress side 97. Tubular leg 22 includes a depth. A first plane set at a right angle to tubular leg 22 is disposed at a greater depth than a second plane set at a right angle to tubular leg 22. Such first plane is tangential to intermediate frame tube portions 64, 68 along a length of such frame portions 64, 68. Such second plane is tangential to lowermost frame tube portions 54, 58 along a length of such frame portions 54, 58.

In operation, to swing down the rail portion 14 from a position where the front face of the rail portion 14 confronts the mattress side 97 and the rear face of the rail portion 14 faces away from the mattress side 97, the connector pins 48 are disengaged from their respective bases 16, whereupon the rail portion 14 can be swung or pivoted downwardly such that the rear face of the rail portion 14 confronts the mattress support side 98 and such that the front face of the rail portion 14 faces away from the mattress support side 98.

FIGS. 6, 7, 8, 9, and 10 show a second embodiment of the present invention, namely, a bed rail 100 having offset rail portions. Bed rail 100 includes the pair of leg portions 12, the pair of bases 16, the tubular leg 18, the end cap 20, the flexible strap 22, the counter member 24, and the catch mechanism 25. Bed rail 100 includes a rail portion 114.

Rail portion 114 includes a frame 132. Frame 132 includes a pair of end rails 134, a lowermost crossing rail 136, an intermediate crossing rail 138, and an uppermost crossing rail 140. Crossing rails 136, 138, 140 extend across the rail portion 114 from one end rail 134 to the other end rail 134.

Figure 6:
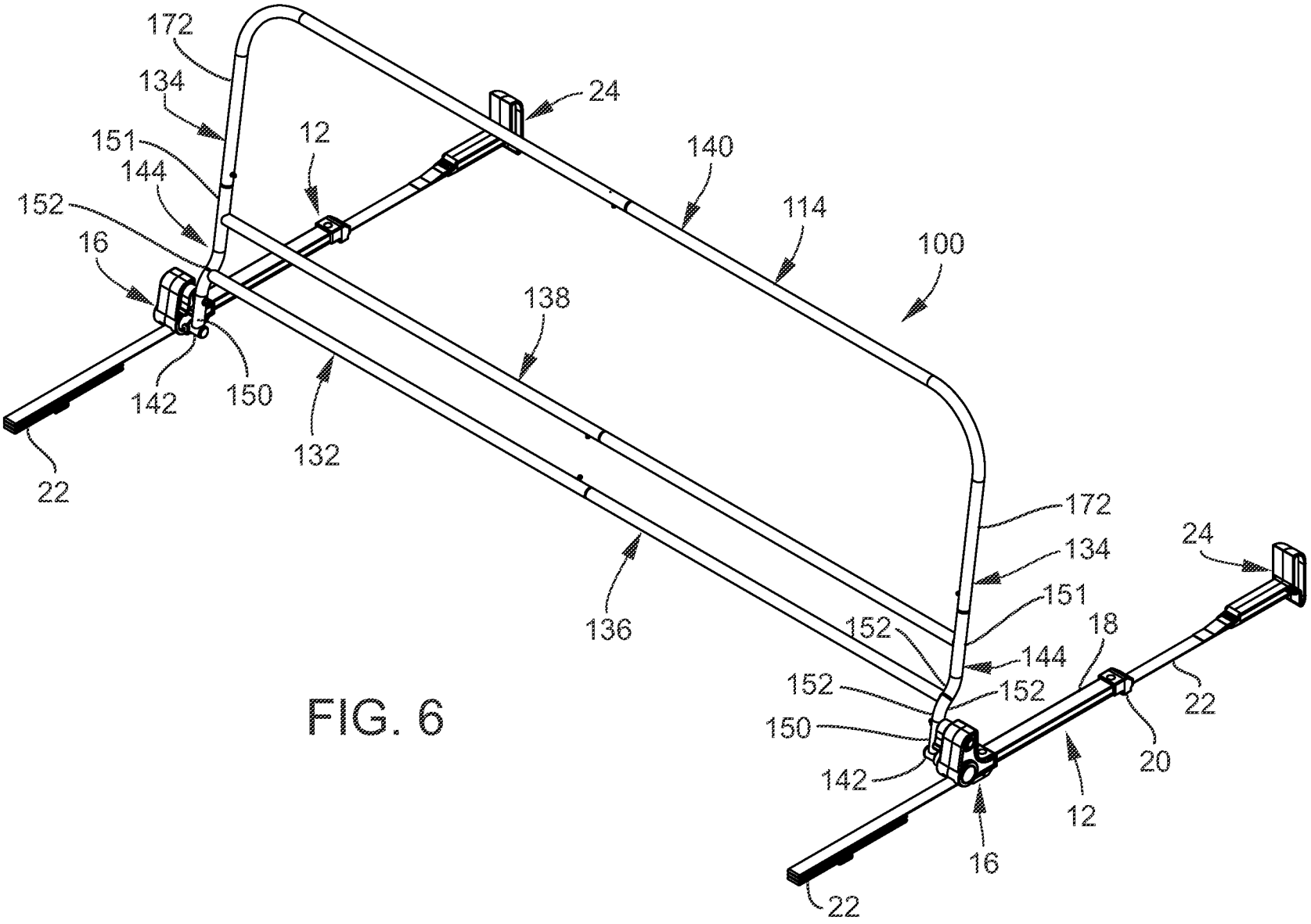
FIG. 6 is a perspective view of a second embodiment of an offset bed rail.
Figure 7:
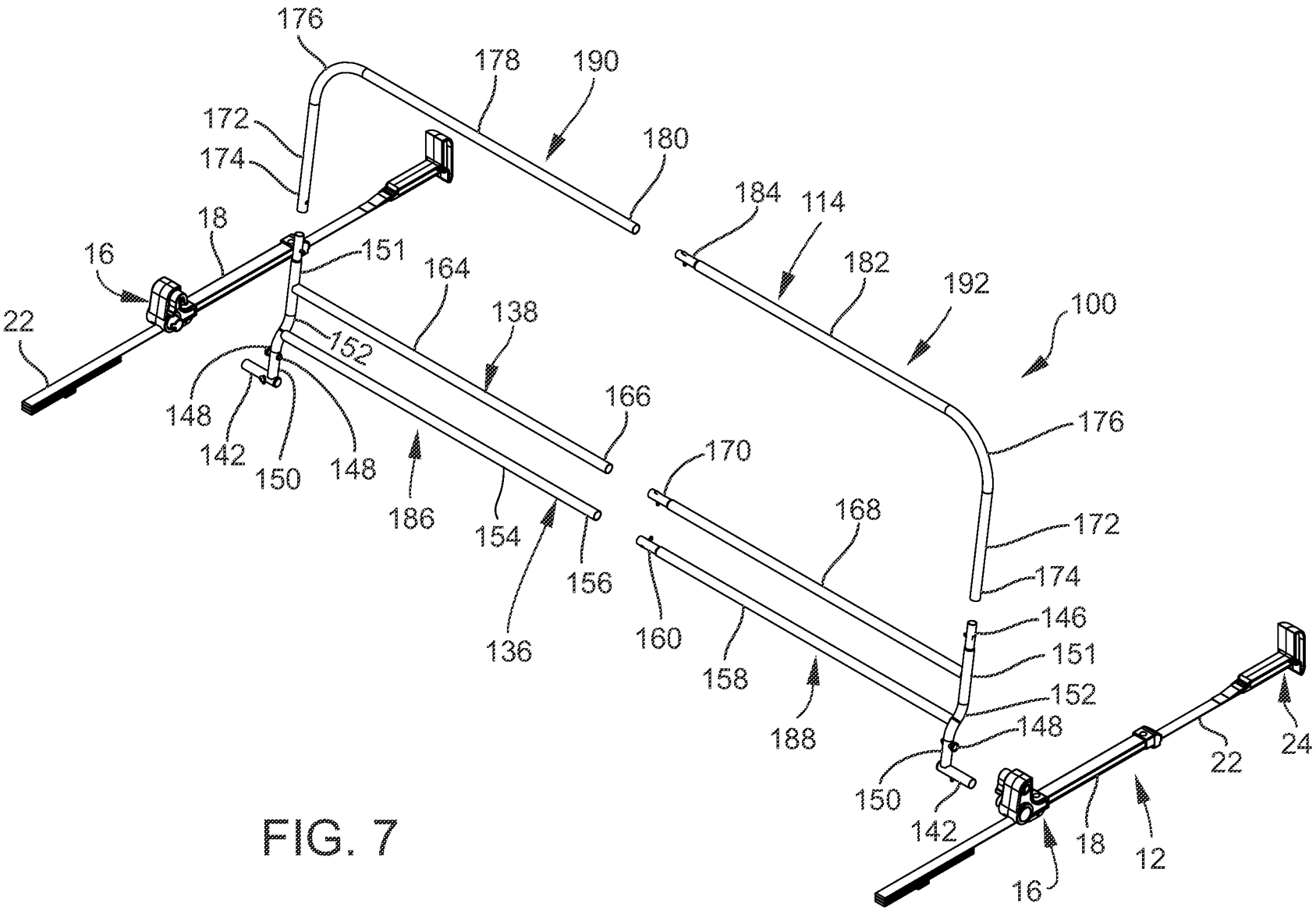
FIG. 7 is an exploded perspective view of the offset bed rail of FIG. 6.

As shown in FIGS. 6 and 7, lowermost crossing rail 136 includes a pair of straight pivot frame portions 142. Pivot frame portion 142 is pivotally engaged to its respective base 16. Rail portion 114 swings upwardly and downwardly relative to bases 16 and leg portions 12 through pivot frame portions 142. Pivot frame portion 142 extends inwardly from its respective base 16 to and slightly beyond its respective end rail 134.

Each of the end rails 134 includes a lowermost S-shaped rail portion 144. The proximal end of end rail portion 144 is engaged to pivot frame portion 142 at a right angle. Lowermost end rail portion 144 includes a distal end 146 that is a male connecting portion and that includes a spring biased button. Lowermost end rail portion 144 includes a headed spring biased connector pin 148 that engages its respective base 16 to fix the rail portion 14 in an operating position adjacent to the side of the mattress and not adjacent to the side of the mattress support. When the head of the connector pin 148 is disengaged from its respective base 16, the rail portion 114 can swing down so as to be adjacent to the side of the mattress support and not adjacent to the side of the mattress.

A left straight frame portion 150 of the left lowermost end rail portion 144 extends between the left connector pin 148 and the left pivot frame portion 142. A right straight frame portion 150 of the right lowermost end rail portion 144 extends between the right connector pin 148 and the right pivot frame portion 142. Axis of the left and right frame portions 150 define a base plane. When the rail portions 144 and frame portions 150 swing, so does the base plane swing. Frame portions of the rail portion 114, as discussed below, are disposed forwardly of and spaced from the base plane.

As indicated above, pivot frame portion 142 extends in a straight manner inwardly from its respective base 16 to and slightly beyond its respective end rail 134. Slightly inwardly of each of respective end rails 134, the straight pivot frame portion 142 terminates where its straight structure terminates.

Each of the end rails 134 includes a pair of straight frame portions. The first straight frame portion is frame portion 150 that is disposed between pivot frame portion 142 and connector pin 148. The second straight frame portion is offset frame portion 151 that is the uppermost frame portion of end frame portion 144. Offset frame portion 151 includes male connector portion 146. Disposed between the straight frame portion 150 and offset straight frame portion 151 is a curved or undulating transition offset portion 152 that curves forwardly of the base plane and into the pair of left and right offset straight tubular frame portions 151. The undulating axis of left and right offset frame portions 152 lie forwardly of the base plane defined by the axis of frame portions 150. The straight axis of left and right offset frame portions 151 lie forwardly of and are spaced from the base plane defined by the axis of frame portions 150.

Extending from the left undulating frame portion 152 is a straight offset tubular frame portion 154 with a female connector inner end 156. Extending from the right undulating frame portion 152 is a straight offset tubular frame portion 158 with a male connector inner end 160. Male connector inner end 160 includes a spring biased button that engages a button hole in the female connector inner end 156 such that female connector inner end 156 engages male connector inner end 160. Frame portions 154, 158 are aligned with each other such that both lie on the same straight axis when engaged with each other. The axis of frame portions 154, 158 lie forwardly of and are spaced from the base plane defined by frame portions 150. Frame portions 154, 158 as a whole lie forwardly of and are spaced from the base plane defined by the axis of frame portions 150.

Rail portion 114 includes intermediate rail 138. Extending from the left straight frame portion 151 is a straight offset tubular frame portion 164 with a female connector inner end 166. Extending from the right straight frame portion 151 is a straight offset tubular frame portion 168 with a male connector inner end 170. Male connector inner end 170 includes a spring biased button that engages a button hole in the female connector inner end 166 such that female connector inner end 166 engages male connector inner end 170. Frame portions 164, 168 are aligned with each other such that both lie on the same straight axis when engaged with each other. The axis of frame portions 164, 168 lie forwardly of and are spaced from the base plane defined by the axis of frame portions 150. Frame portions 164, 168 as a whole lie forwardly of and are spaced from the base plane defined by the axis of frame portions 50.

Rail portion 114 includes a pair of left and right straight uppermost tubular end frame portions 172 that lie on the same straight axis as lowermost end rail portions 151. Each of the left and right straight uppermost end rail portions 172 include female lower connector ends 174 that receive and engage the distal male ends 146 of the end rail portions 151.

Rail portion 14 includes a pair of left and right curved transition tubular frame portions 176 that are integral and one piece with uppermost left and right uppermost end frame portions 172.

Extending from the left curved transition frame portion 176 is a straight tubular uppermost frame portion 178 with a female connector inner end 180. Extending from the right curved transition frame portion 176 is a straight tubular frame uppermost frame portion 182 with a male connector inner end 184. Male connector inner end 184 includes a spring biased button that engages a button hole in the female connector inner end 180 such that female connector inner end 180 engages male connector inner end 184. Frame portions 178, 182 are aligned with each other such that both lie on the same straight axis when engaged with each other.

The straight axis of pivot frame portion 142 and end frame portion 150 lie in the base plane. These are the only frame portions of frame 132 of rail portion 114 that lie in the base plane. The remaining frame portions of frame 132 have an axis that lies forwardly of the base plane.

Undulating frame portion 152 has an undulating axis that lies forwardly of the base plane.

The following frame portions of frame 132 of rail portion 114 have 1) an axis that lies forwardly of the base plane and 2) as a whole lie forwardly of the base plane: a) lowermost frame portion 136 that includes frame portions 154, 158, b) intermediate frame portion 138 that includes frame portions 164, 168, c) uppermost frame portion 140 that includes frame portions 178, 182, d) end rail portions 151, e) end rail portions 172, and f) curved transition portions 176.

Figure 9:
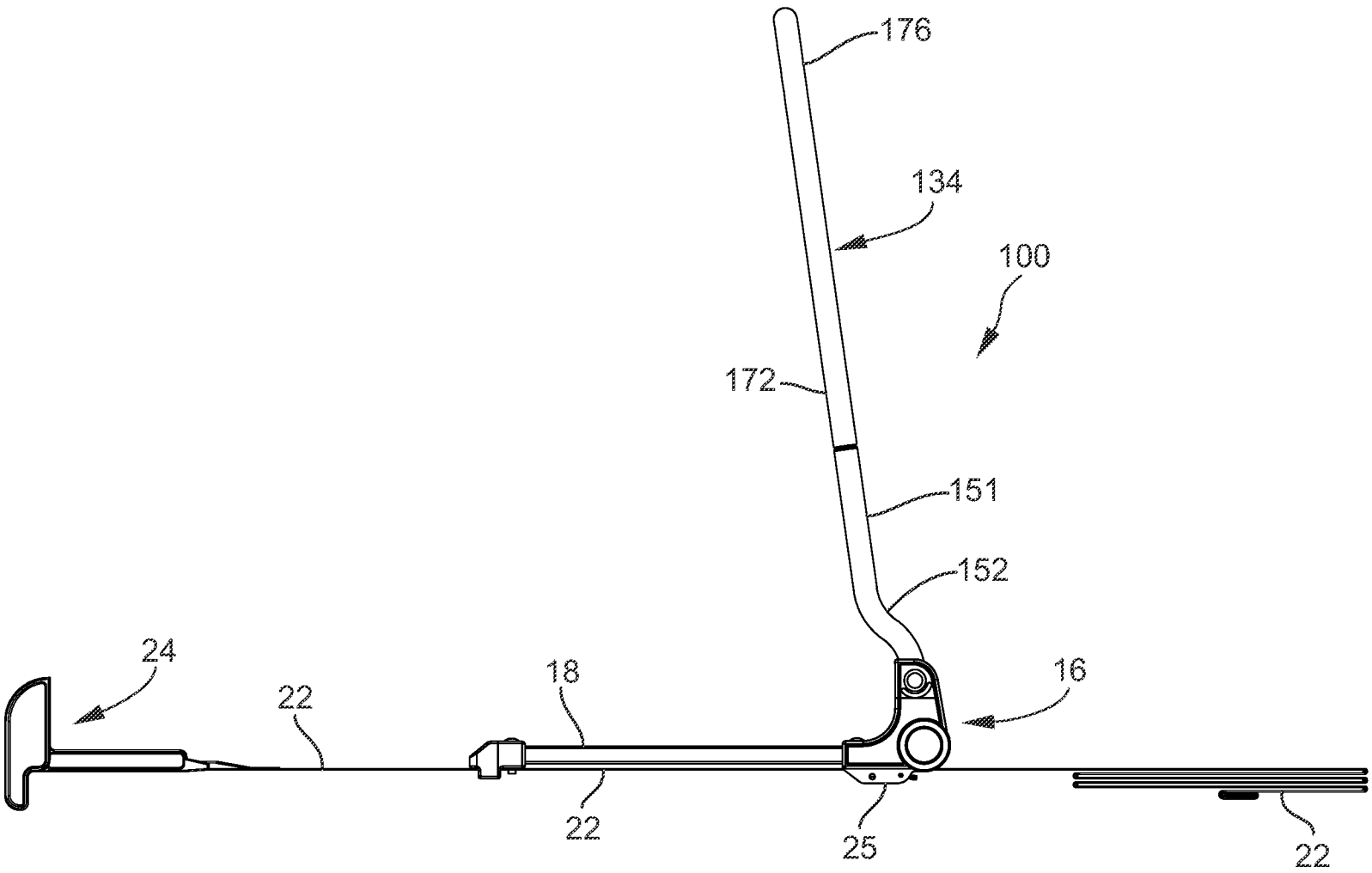
FIG. 9 is a side view of the offset bed rail of FIG. 6.
Figure 10:
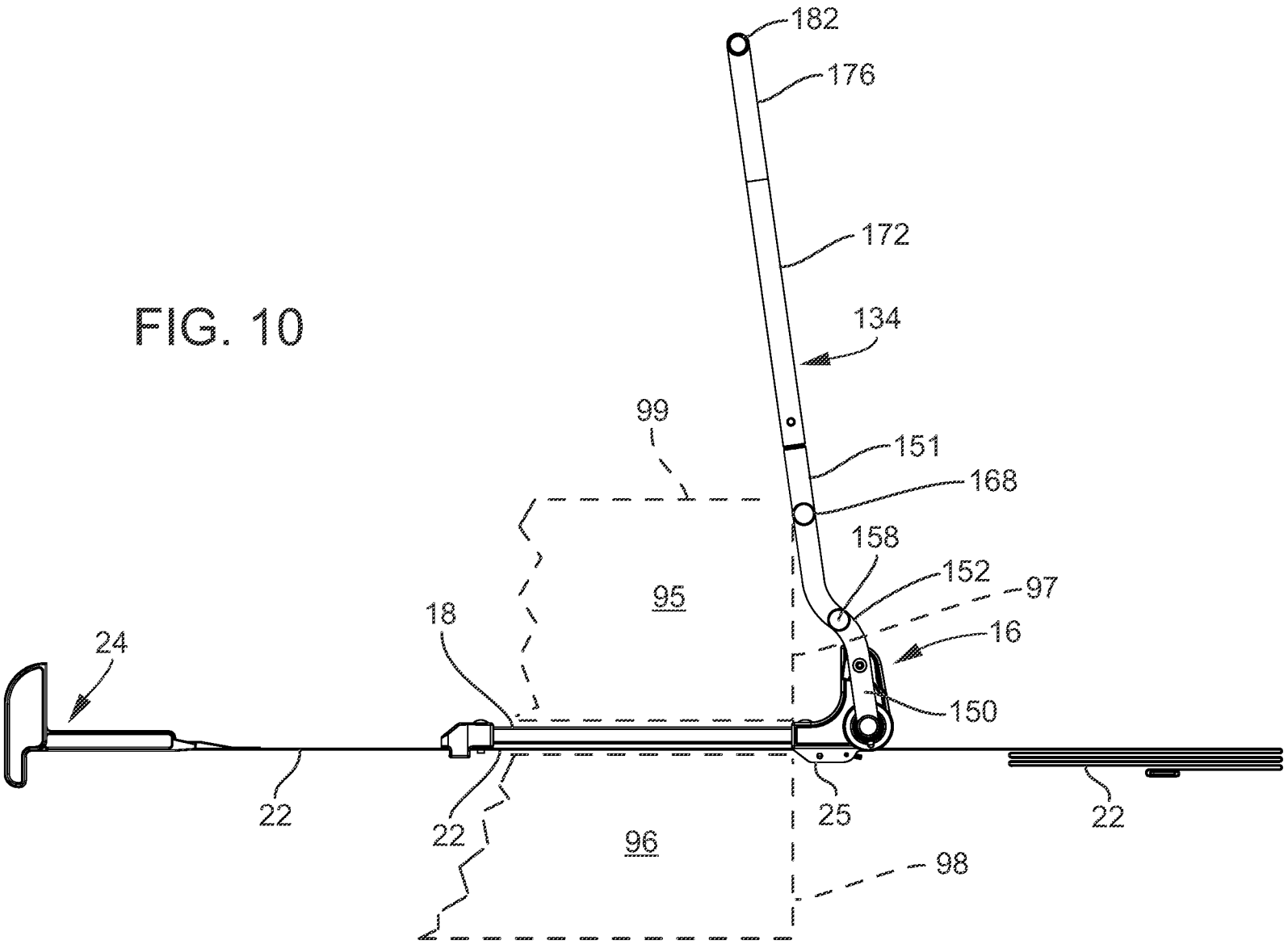
FIG. 10 is a section view of the offset bed rail of FIG. 6.

FIGS. 9 and 10 show that straight end frame portions 151, 172 are oblique relative to a first plane that extends at a right angle to a second plane defined by the tubular legs 18. Frame portions 150 are also oblique relative to the first plane.

Figure 8:
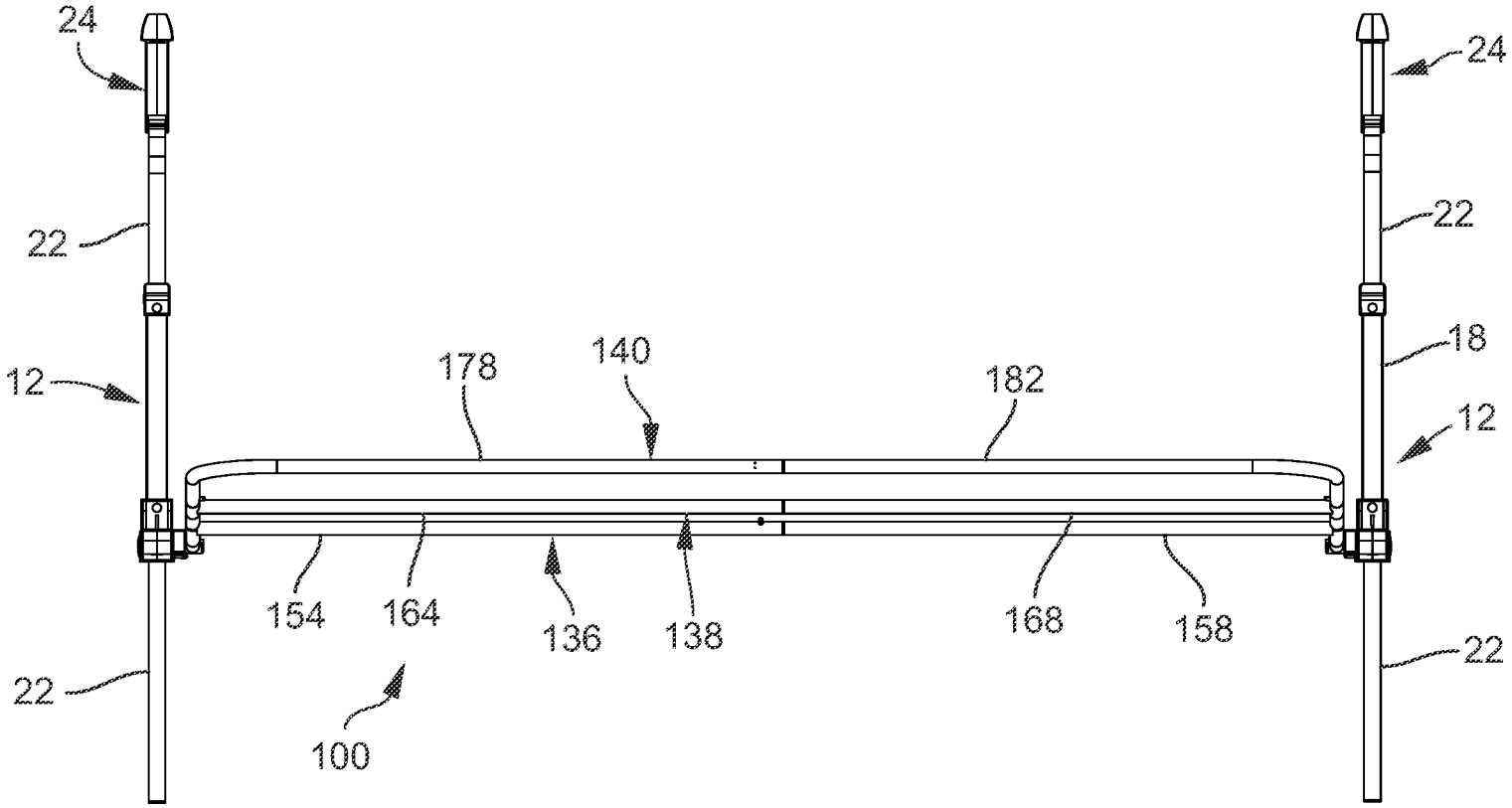
FIG. 8 is a top view of the offset bed rail of FIG. 6.

FIG. 8 shows that the frame portions 154 and 158 make up preferably more than one-half the length of the bed rail 100, and more preferably, more than 70% of the length of the bed rail 100 as measured from the outermost portion of left base 16 to the outermost portion of right base 16. FIG. 8 shows that the frame portions 164 and 168 make up preferably more than one-half the length of the bed rail 100, and more preferably, more than 70% of the length of the bed rail 100 as measured from the outermost portion of left base 16 to the outermost portion of right base 16. FIG. 8 shows that the frame portions 176, 178, and 182 make up preferably more than one-half the length of the bed rail 100, and more preferably, more than 70% of the length of the bed rail 100 as measured from the outermost portion of left base 16 to the outermost portion of right base 16. FIG. 8 shows that the end rails 134 of bed rail 100 have offset rail portions, including offset rail portions 152, 151, 172, and one-half portion of frame portion 176, that make up preferably more than one-half the height of the bed rail 100, and more preferably, more than 75% of the height of the bed rail 100, and still more preferably, more than 80% of the height of the bed rail 100.

FIG. 10 shows frame member 150. FIGS. 8, 9 and 10 show that the axis of undulating frame portions 152 lie forwardly of the base plane defined by the axis of frame portions 150, that frame portions 154, 158 as a whole lie forwardly of and are spaced from the base plane defined by the axis of frame portions 150, that frame portions 164, 168 as a whole lie forwardly of and are spaced from the base plane defined by the axis of frame portions 150, that frame portions 176, 178, and 182 as a whole lie forwardly of and are spaced from the base plane defined by the axis of frame portions 150, and that frame portions 151 as a whole lie forwardly of and are spaced from the base plane defined by the axis of frame portions 150.

As shown by the exploded view of FIG. 7, rail portion 114 includes four frame units 186, 188, 190, 192. In each of the units 186, 188, 190, and 192, the parts are integral and one piece with each other. The units 186, 188, 190, 192 are shipped in the integral and one piece form. The units 186, 188, 190, 192 are engaged to each other by the end user to form the rail portion 114. The left lowermost unit 186 includes frame portions 154, 164, 152, 150, 142 and 151. The right lowermost unit 188 includes frame portions 158, 168, 152, 150, 142, and 151. The left uppermost unit 190 includes frame portions 178, 176, and 172. The right uppermost unit 192 includes frame portions 182, 176, and 172.

In operation, the bed rail 100 is shipped in the broken apart form shown in FIG. 7. Base 16 is one piece with tubular leg 18 in the shipped form. Strap 22 is engaged with tubular leg 18 and with counter member 24 in the shipped form. The end user then engages female inner ends 156, 166, and 180 with their respective male ends 160, 170, and 184, and then engages left and right male portions 146 with their respective left and right female connection portions 174. With the exception that unit 190 is identical to unit 192 such that either unit 190 or 192 can be a left or right uppermost unit, there is only one unique way that the bed rail 100 can be put together and such unique way is the correct way.

In operation, to engage the bed rail 100 to a bed 94 having a mattress 95 and a mattress support 96, where the mattress 95 includes a side 97 and the mattress support 96 includes a side 98, and where the mattress 95 includes a sleeping surface 99, the rail portion 114 is swung up and locked in the operating position such that connector pin 148 engages both the base 16 and the rail portion 114. Then the leg portions 12 are tucked between the mattress 95 and the mattress support 96 and the strap 22 with the counter member 24 is pulled through the space between the mattress 95 and mattress support 96 such that the counter member 24 can engage the mattress and mattress support sides that are opposite of sides 97, 98. Then strap 22 is tightened until the end rails 134 make contact with the mattress side 97 and the intermediate rail 138 and lowermost rail 136 are drawn adjacent to the mattress side 97.

Intermediate rail 138, especially intermediate frame portions 164, 168 can be positioned 1) at the junction of mattress side 97 and sleeping surface or mattress top 99, 2) at a location digging into the mattress side 97 adjacent to the sleeping surface or mattress top 99, or 3) at the immediate top of the sleeping surface or mattress top 99 overlying a portion of the sleeping surface or mattress top 99. Lowermost rail 136 is disposed at a location adjacent to and spaced from mattress side 97.

Intermediate rail 138 extends inwardly further than does lowermost rail 136 such that intermediate frame portions 164, 168 are closer to mattress side 97 than are lowermost frame portions 54, 58. Tubular leg 22 includes a depth. A first plane set at a right angle to tubular leg 22 is disposed at a greater depth than a second plane set at a right angle to tubular leg 22. Such first plane is tangential to intermediate frame tube portions 164, 168 along the length of such frame portions 164, 168. Such second plane is tangential to lowermost frame tube portions 154, 158 along the length of such frame portions 154, 158.

In operation, to swing down the rail portion 114 from a position where the front face of the rail portion 114 confronts the mattress side 97 and the rear face of the rail portion 114 faces away from the mattress side 97, the connector pins 148 are disengaged from their respective bases 16, whereupon the rail portion 114 can be swung or pivoted downwardly such that the rear face of the rail portion 114 confronts the mattress support side 98 and such that the front face of the rail portion 114 faces away from the mattress support side 98.

As to base 16, connector pins 48, 148, and as to bed rails 10, 100, and 200 as a whole, the Flannery et al. U.S. Pat. No. 8,458,831 B2 issued Jun. 11, 2013 and entitled Bed Rail Having Rotating Seat For Guard Frame is hereby incorporated by reference in its entirety.

Figure 11:
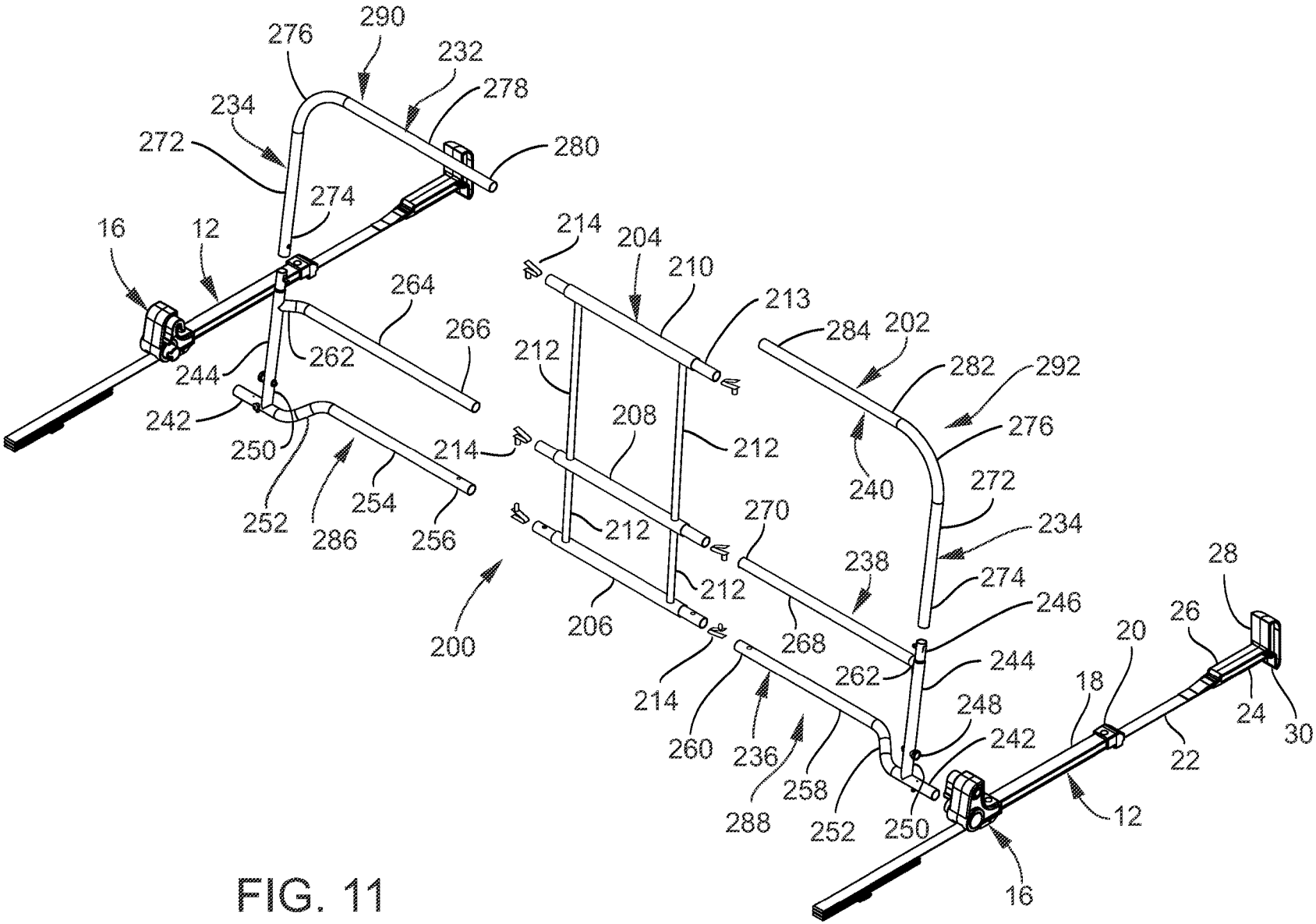
FIG. 11 is an exploded perspective view of a third embodiment of an offset bed rail.

FIG. 11 shows a third embodiment of an offset bed rail. Here offset bed rail 200 includes the base structure of offset bed rail 10 shown in FIG. 1 except that the rail portion 14 is different. Here, instead of rail portion 14, offset bed rail 200 includes a rail portion 202 having an intermediate rail portion 204 or intermediate rail unit 204.

Figure 12A:
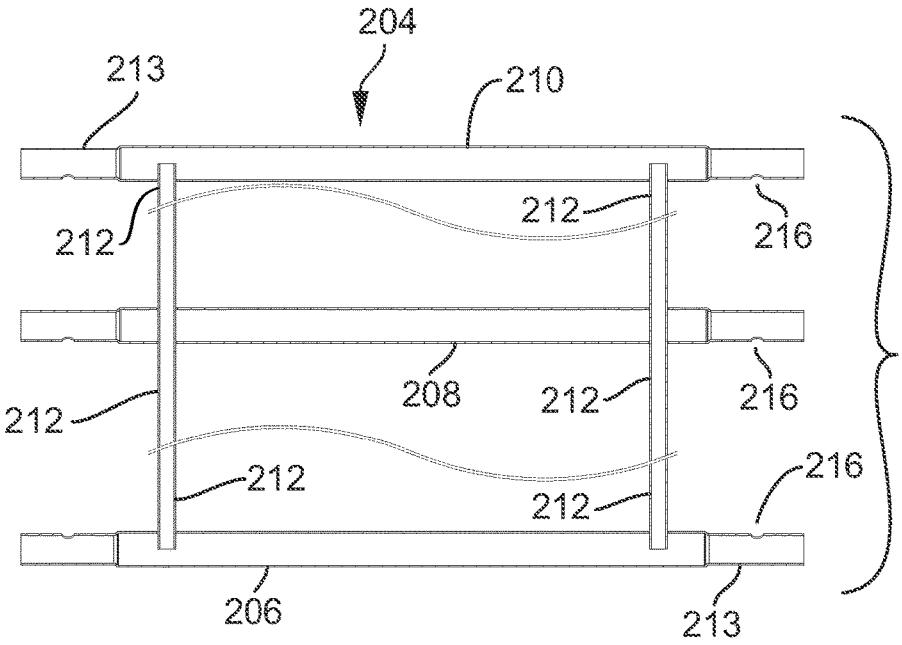
FIG. 12A is a schematic front view of an intermediate rail portion of the offset bed rail of FIG. 11.
Figure 12B:
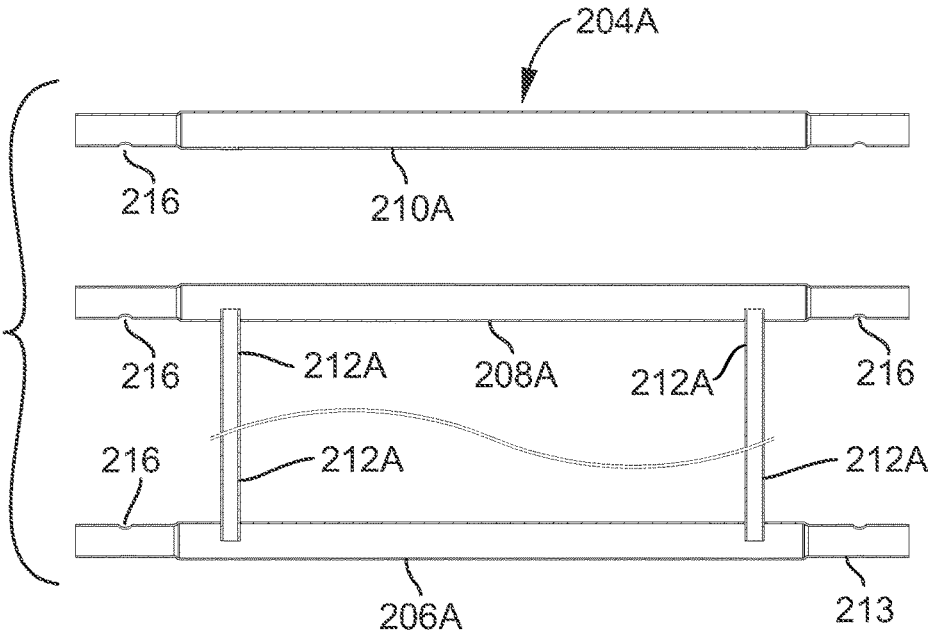
FIG. 12B is a schematic front view of a modification of the intermediate rail portion of FIG. 12A.

Intermediate rail portion 204 includes a lowermost tubular straight rail portion 206, an intermediate tubular straight rail portion 208, and an uppermost tubular straight rail portion 210. Rail portions 206, 208, 210 run parallel to each other. Rail portions 206, 208, 210 are rigidly fixed to each other by a pair of tubular posts 212. Tubular posts 212 engage through openings in intermediate rail portion 208 and are fixed, such as by welding, to intermediate rail portion 208. Tubular posts 212 extend through lower openings in uppermost rail portion 210, with the upper ends of posts 212 terminating short of the uppermost inner diametrical surface of uppermost rail portion 210, as shown in FIG. 12A. Tubular posts 212 are fixed, such as by welding, to uppermost rail portions 210. Tubular posts 212 extend through upper openings in lowermost rail portion 206, with the lower ends of posts 212 terminating short of the lowermost inner diametrical surface of lowermost rail portion 206, as shown in FIG. 12A. Tubular posts 212 are fixed, such as by welding, to lowermost rail portions 206. Outer ends of each of the rail portions 206, 208, 210 are male connector portions 213 having spring biased button apparatus 214. Button holes 216 for spring biased button apparatus 214 are disposed in the tops of the male connector portions 213 of lowermost rail portion 206. Button holes 216 for spring biased button apparatus 214 are disposed in the bottoms of the male connector portions 213 of each of the intermediate and uppermost rail portions 208, 210. FIG. 12B shows that, if desired, tubular posts 212A may engage lowermost and intermediate rail portions 206A, 208A and not engage uppermost rail portion 210A.

Offset bed rail 200 includes the pair of leg portions 12, the rail portion 202, and the pair of bases 16. The rail portion 202 is swingably engaged to the bases 16. The leg portion 12 is fixedly engaged to its respective base 16. Each of the leg portions 12 includes the straight metal tubular leg 18 fixedly received in its respective base 16. At its distal end, the tubular leg 18 is closed off by the end cap 20. Leg portion 12 includes the flexible strap 22 and the counter member 24. Flexible strap 22 is engaged to the underside of the tubular leg 18 by the slot formed in the underside of the cap 20 and by the catch mechanism 25 depending from a proximal end portion of the tubular leg 18 adjacent to the base 16. Flexible strap 22 may be adjustably lengthened and shortened to let out and draw in the counter member 24 that is engaged to a distal end of the flexible strap 22. Counter member 24 includes the planar portion 26, the upright portion 28 that confronts a side of a mattress, and the downwardly extending portion 30 that confronts a side of a mattress support. By pulling on the proximal end of the strap 22 and operating the catch mechanism 25 on the bottom side of the proximal end of the tubular leg 18, the counter member 24 may be drawn tightly against the far side of the mattress and mattress support to squeeze the mattress between the counter member 24 and the bases 16 and rail portion 202.

Rail portion 202 is a portion of the bed rail 200. Another portion of the bed rail 200 is the leg portion 12. Another portion of the bed rail 200 is the pair of bases 16. Another portion of the bed rail 200 is sheeting on the rail portion 14.

Rail portion 202 includes a frame 232. Frame 232 includes a pair of end rails 234, a lowermost crossing rail 236, an intermediate crossing rail 238, and an uppermost crossing rail 240. Crossing rails 236, 238, 240 extend across the rail portion 202 from one end rail 234 to the other end rail 234.

As shown in FIG. 11, lowermost crossing rail 236 includes a pair of straight pivot frame portions 242 that are outer end portions of lowermost crossing rail 236. Pivot frame portion 242 is pivotally engaged to its respective base 16. Rail portion 202 swings upwardly and downwardly relative to bases 16 and leg portions 12 through pivot frame portions 242. Pivot frame portion 242 extends inwardly from its respective base 16 to and slightly beyond its respective end rail 234.

Each of the end rails 234 includes a lowermost straight end rail portion 244. End rail portion 244 is engaged to lowermost crossing rail 236 at a right angle. Lowermost end rail portion 244 includes a distal end 246 that is a male connecting portion and that includes a spring biased button. Lowermost end rail portion 244 includes a headed spring biased connector pin 248 that engages its respective base 16 to fix the rail portion 202 in an operating position adjacent to the side of the mattress and not adjacent to the side of the mattress support. When the head of the connector pin 248 is disengaged from its respective base 16, the rail portion 202 can swing down so as to be adjacent to the side of the mattress support and not adjacent to the side of the mattress.

A left straight frame portion 250 of the left lowermost end rail portion 244 extends between the left connector pin 248 and the left pivot frame portion 242. A right straight frame portion 250 of the right lowermost end rail portion 244 extends between the right connector pin 248 and the right pivot frame portion 242. Axis of the left and right frame portions 250 define a base plane. When the rail portions 244 and frame portions 250 swing, so does the base plane swing. Frame portions of the rail portion 202, as discussed below, are disposed forwardly of and spaced from the base plane.

As indicated above, pivot frame portion 242 extends in a straight manner inwardly from its respective base 16 to and slightly beyond its respective end rail 234. Slightly inwardly of each of the respective end rails 234, the straight pivot frame portion 242 terminates where its straight structure terminates, and here lowermost rail 236 curves forwardly of the base plane and into a pair of left and right offset S-shaped transition tubular frame portions 252. The axis of left and right offset frame portions 252 lie forwardly of and are spaced from the base plane defined by the axis of frame portions 250.

Extending from the left S-shaped frame portion 252 is a straight offset tubular frame portion 254 with a female connector inner end 256. Extending from the right S-shaped frame portion 252 is a straight offset tubular frame portion 258 with a female connector inner end 260.

Female connector inner ends 256, 260 engage the male connector portions 213 of lower frame portion 206 of intermediate rail portion 204 and are locked thereto by spring biased button apparatus 214.

Frame portions 254, 258, 206 are aligned with each other such that all three portions lie on the same straight axis when engaged with each other. The axis of frame portions 254, 258, 206 lie forwardly of and are spaced from the base plane defined by the axis of frame portions 250. Frame portions 254, 258, 206 as a whole lie forwardly of and are spaced from the base plane defined by the axis of frame portions 250.

Rail portion 202 includes intermediate rail 238. Intermediate rail 238 includes a left outer end transition tubular frame portion 262 and a right outer end transition tubular frame portion 262. Each of the frame portions 262 extends inwardly from lowermost end rail portion 244. The axis of frame portions 262 lie forwardly of and are spaced from the base plane defined by the axis of frame portions 250.

Extending from the left transition frame portion 262 is a straight offset tubular frame portion 264 with a female connector inner end 266. Extending from the right transition frame portion 262 is a straight offset tubular frame portion 268 with a female connector inner end 270.

Female ends 266, 270 engage the male connector portions 213 of intermediate rail portion 208 by the spring biased button apparatus 214. Frame portions 264, 268, 208 are aligned with each other such that these frame portions lie on the same straight axis when engaged with each other. The axis of frame portions 264, 268, 208 lie forwardly of and are spaced from the base plane defined by the axis of frame portions 250. Frame portions 264, 268 as a whole lie forwardly of and are spaced from the base plane defined by the axis of frame portions 250.

Rail portion 202 includes a pair of left and right straight uppermost tubular end frame portions 272 that lie on the same straight axis as lowermost end rail portions 244. Each of the left and right straight uppermost end rail portions 272 include female lower connector ends 274 that receive and engage the distal male ends 246 of the lowermost end rail portions 244.

Rail portion 202 includes a pair of left and right curved transition tubular frame portions 276 that are integral and one piece with uppermost left and right uppermost end frame portions 272.

Extending from the left curved transition frame portion 276 is a straight tubular uppermost frame portion 278 with a female connector inner end 280. Extending from the right curved transition frame portion 276 is a straight tubular frame uppermost frame portion 282 with a female connector inner end 284. Female inner ends 280, 284 engage the male connector portions 213 of uppermost rail portion 210 by the spring biased button apparatus 214.

Frame portions 278, 282, 210 are aligned with each other such that these frame portions lie on the same straight axis when engaged with each other.

The straight axis of frame portions 278, 282, 210 lie in the base plane. The straight axis of frame portions 244 and 272 also lie in the base plane. The curved axis of frame portions 276 also lie in the base plane. The straight axis of pivot frame portions 242 also lie in the base plane.

As with bed rail 10 as shown in FIGS. 3, 4 and 5, straight end rails 234 are oblique relative to a first plane that extends at a right angle to a second plane defined by the tubular legs 18.

Frame portions 254, 258, 206 make up preferably more than one-half the length of the bed rail 200, and more preferably, more than 70% of the length of the bed rail 200 as measured from the outermost portion of left base 16 to the outermost portion of right base 16. Frame portions 264, 268, 208 make up preferably more than one-half the length of the bed rail 200, and more preferably, more than 70% of the length of the bed rail 200 as measured from the outermost portion of left base 16 to the outermost portion of right base 16. The end rails 234 of bed rail 200 have no offset frame portions such that there is no measurement for the percentage of the rail portion 202 having offset frame portions.

The axis of frame portions 254, 258, 206 lie forwardly of and are spaced from the base plane defined by the axis of frame portions 250. Frame portions 254, 258, 206 as a whole lie forwardly of and are spaced from the base plane defined by the axis of frame portions 250. The axis of frame portions 264, 268, 208 lie forwardly of and are spaced from the base plane defined by the axis of frame portions 250. Frame portions 264, 268, 208 as a whole lie forwardly of and are spaced from the base plane defined by the axis of frame portions 250.

As shown by the exploded view of FIG. 11, rail portion 202 includes five frame units 204, 286, 288, 290, 292. In each of the units 204, 286, 288, 290, and 292, the parts are integral and one piece with each other. The units 204, 286, 288, 290, 292 are shipped in the integral and one piece form. The units 204, 286, 288, 290, 292 are engaged to each other by the end user to form the rail portion 202. Unit 204 includes the rail portions 206, 208, 210, and the posts 212. The left lowermost unit 286 includes frame portions 254, 264, 252, 250, 262, 242 and 244. The right lowermost unit 288 includes frame portions 258, 268, 252, 250, 262, 242, and 244. The left uppermost unit 290 includes frame portions 278, 276, and 272. The right uppermost unit 292 includes frame portions 282, 276, and 272.

As shown in FIG. 12A, rail portion 202 may include six units, where four of the units are units 286, 288, 290, and 292, where a fifth unit is lowermost rail portion 206A, intermediate rail portion 208A and shortened posts 212A, and where a sixth unit is uppermost rail portion 210A. Rail portion 210A engages rail portions 278, 280. Rail portion 208A engages rail portions 264, 268. Rail portion 206A engages rail portions 254, 258. Shortened posts 212A terminate short of the inside upper diameter of rail portion 208A and terminate short of the inside lower diameter of rail portion 206A. Tubular posts 212A are fixed, such as by welding, to rail portions 206A and 208A. Rail portions 206A, 208A, and 210A run parallel to each other.

In operation, the bed rail 200 is shipped in the broken apart form shown in FIG. 11. Base 16 is one piece with tubular leg 18 in the shipped form. Strap 22 is engaged with tubular leg 18 and with counter member 24 in the shipped form. The end user then engages female ends 274 with male ends 246. The end user then engages female inner ends 256, 266, and 280 of units 286, 290 with their respective male ends 213 of unit 204. The end user then engages female inner ends 260, 270, 284 of units 288, 292 with their respective male ends 213 of unit 204.

With the exception that unit 290 is identical to unit 292 such that either unit 290 or 292 can be a left or right uppermost unit, and with the exception that unit 204 can be rotated 180 degrees on a central vertical axis and engage units 286, 290, 288, 292 either rotational way, there is only one unique way that the bed rail 200 can be put together and such unique way is the correct way.

In operation, to engage the bed rail 200 to a bed 94 having a mattress 95 and a mattress support 96, where the mattress 95 includes a side 97 and the mattress support 96 includes a side 98, and where the mattress 95 includes a sleeping surface 99, the rail portion 202 is swung up and locked in the operating position such that each of the connector pins 248 engages both its respective base 16 and the rail portion 202. Then the leg portions 12 are tucked between the mattress 95 and the mattress support 96 and the strap 22 with the counter member 24 is pulled through the space between the mattress 95 and mattress support 96 such that the counter member 24 can engage the mattress and mattress support sides that are opposite of sides 97, 98. Then strap 22 is tightened until the mattress side 97 makes contact with the end rails 234 and further makes contact with the intermediate rail 238 and lowermost rail 236.

Intermediate rail 238, especially intermediate frame portions 264, 268, 208 can be positioned 1) at the junction of mattress side 97 and sleeping surface or mattress top 99, 2) at a location digging into the mattress side 97 adjacent to the sleeping surface or mattress top 99, or 3) at the immediate top of the sleeping surface or mattress top 99 overlying a portion of the sleeping surface or mattress top 99. Lowermost rail 236, especially lowermost frame portions 254, 258, 206 can be disposed 1) at a location immediately at or adjacent to mattress side 97, or 2) at a location digging into mattress side 97.

Intermediate rail 238 extends inwardly further than does lowermost rail 236 such that intermediate frame tube portions 264, 268, 208 dig into mattress side 97 and such that lowermost frame portions 54, 58 make contact with mattress side 97. Tubular leg 22 includes a depth. A first plane set at a right angle to tubular leg 22 is disposed at a greater depth than a second plane set at a right angle to tubular leg 22. Such first plane is tangential to intermediate frame tube portions 264, 268, 208 along a length of such frame portions 264, 268, 208. Such second plane is tangential to lowermost frame tube portions 254, 258, 206 along a length of such frame portions 254, 258, 206.

In operation, to swing down the rail portion 202 from a position where the front face of the rail portion 202 confronts the mattress side 97 and the rear face of the rail portion 202 faces away from the mattress side 97, the connector pins 248 are disengaged from their respective bases 16, whereupon the rail portion 202 can be swung or pivoted downwardly such that the rear face of the rail portion 202 confronts the mattress support side 98 and such that the front face of the rail portion 202 faces away from the mattress support side 98.

It should be noted that the second embodiment of FIG. 6 may also have an intermediate frame unit identical to unit 204, except that the section of posts 212 between a) the lowermost crossing members 154, 158, 206 and b) the intermediate crossing members 164, 168, 208 takes the shape of end members 151, 152 such that members 178, 182, 210, 164, 168, 208 are in a first offset plane and such that members 154, 158, 206 are in a second offset plane parallel to the first offset plane where the second offset plane is forwardly of the base plane defined by members 150.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A swing down bed rail for a bed, the bed having a mattress and mattress support, each of the mattress and mattress support having a first side and a second side, the mattress having a sleeping surface, the swing down bed rail comprising:

a) a rail portion for being disposed adjacent to the first side of the mattress, the rail portion extending from the first side of the mattress to beyond the sleeping surface to minimize a person rolling off the sleeping surface, the rail portion having a length and a height;

b) first and second leg portions for being disposed between the mattress and mattress support;

c) the rail portion being swingably engaged to each of the first and second leg portions about first and second axes, respectively, such that the rail portion can swing from being disposed adjacent the first side of the mattress to being disposed adjacent to the first side of the mattress support;

d) the rail portion including a first end frame portion extending from the first axis and a second end frame portion extending from the second axis, the first and second end frame portions defining a plane having a front face and a rear face;

e) the front face of the plane facing toward the first side of the mattress when the rail portion is disposed adjacent to the first side of the mattress;

f) the rear face of the plane facing away from the first side of the mattress when the rail portion is disposed adjacent to the first side of the mattress;

g) the rear face of the plane facing toward the first side of the mattress support when the rail portion is disposed adjacent to the first side of the mattress support;

h) the front face of the plane facing away from the first side of the mattress support when the rail portion is disposed adjacent to the first side of the mattress support;

i) the rail portion including a first offset frame portion disposed forwardly of the front face of the plane and spaced from the front face of the plane, the first offset frame portion extending for a distance greater than half the length of the rail portion; and j) the first offset frame portion having a first offset frame portion axis, the first offset frame portion axis being adjacent to the first and second axis.

2. The swing down bed rail of claim 1, and further including a second offset frame portion spaced from the first offset frame portion.

3. The swing down bed rail of claim 2, and further including a third offset frame portion spaced from the second offset frame portion.

4. A swing down bed rail for a bed, the bed having a mattress and mattress support, each of the mattress and mattress support having a first side and a second side, the mattress having a sleeping surface, the swing down bed rail comprising:

a) a rail portion for being disposed adjacent to the first side of the mattress, the rail portion extending from the first side of the mattress to beyond the sleeping surface to minimize a person rolling off the sleeping surface, the rail portion having a length and a height;

b) first and second leg portions for being disposed between the mattress and mattress support;

c) the rail portion being swingably engaged to each of the first and second leg portions about first and second axes, respectively, such that the rail portion can swing from being disposed adjacent the first side of the mattress to being disposed adjacent to the first side of the mattress support;

d) the rail portion including a first end frame portion extending from the first axis and a second end frame portion extending from the second axis, the first and second end frame portions defining a plane having a front face and a rear face;

e) the front face of the plane facing toward the first side of the mattress when the rail portion is disposed adjacent to the first side of the mattress;

f) the rear face of the plane facing away from the first side of the mattress when the rail portion is disposed adjacent to the first side of the mattress;

g) the rear face of the plane facing toward the first side of the mattress support when the rail portion is disposed adjacent to the first side of the mattress support;

h) the front face of the plane facing away from the first side of the mattress support when the rail portion is disposed adjacent to the first side of the mattress support;

i) the rail portion including a first offset frame portion disposed forwardly of the front face of the plane and spaced from the front face of the plane, the first offset frame portion extending for a distance greater than half the length of the rail portion; and j) the first offset frame portion having a first offset frame portion axis, the first offset frame portion axis being adjacent to the first and second leg portions.

5. The swing down bed rail of claim 4, and further including a second offset frame portion spaced from the first offset frame portion.

6. The swing down bed rail of claim 5, and further including a third offset frame portion spaced from the second offset frame portion.

* * * * *